United States Patent [19]

Brochu

[11] 4,062,510

[45] Dec. 13, 1977

[54] NURSING BOTTLE HOLDER

[76] Inventor: Edward Brochu, 110 Robinson St., Lynn, Mass. 01905

[21] Appl. No.: 711,381

[22] Filed: Aug. 3, 1976

[51] Int. Cl.[2] ..... A47D 15/00

[52] U.S. Cl. ..... 248/102; 248/104

[58] Field of Search ..... 248/102, 104, 311.3

[56] References Cited

U.S. PATENT DOCUMENTS

| | | | |
|---|---|---|---|
| 1,136,529 | 4/1915 | Hopwood | 248/102 |
| 1,559,740 | 11/1925 | Cardarella | 248/102 |
| 2,060,194 | 11/1936 | Gissubel | 248/102 |
| 2,490,207 | 12/1949 | Cassile | 248/102 |
| 2,594,545 | 4/1952 | Emens | 248/104 |
| 3,366,360 | 1/1968 | Burke | 248/311.3 X |

FOREIGN PATENT DOCUMENTS

| | | | |
|---|---|---|---|
| 86,405 | 5/1952 | Norway | 248/104 |

*Primary Examiner*—Roy D. Frazier
*Assistant Examiner*—Peter A. Aschenbrenner
*Attorney, Agent, or Firm*—Robert D. Farkas

[57] ABSTRACT

A nursing bottle holder that includes a plurality of straps which engage both the bottle and two opposing crib bars and one additional strap and a disc that stabilize movement of the bottle.

6 Claims, 3 Drawing Figures

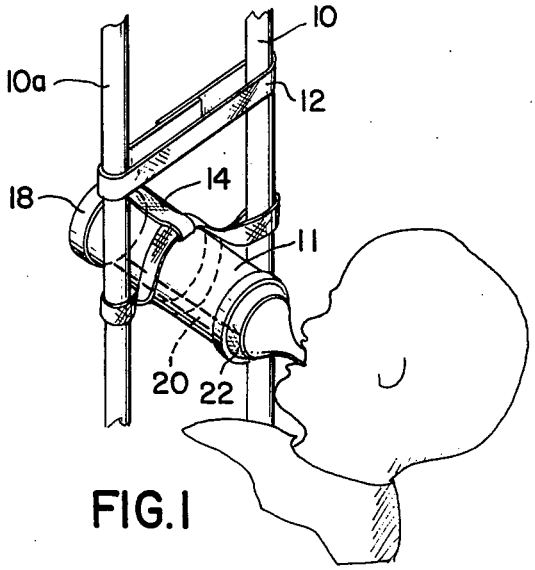
FIG.1
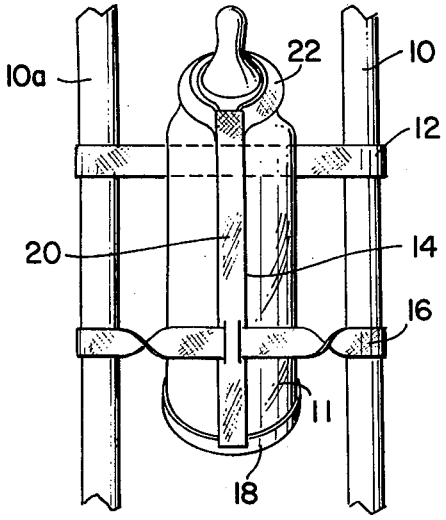
FIG.2
FIG.3
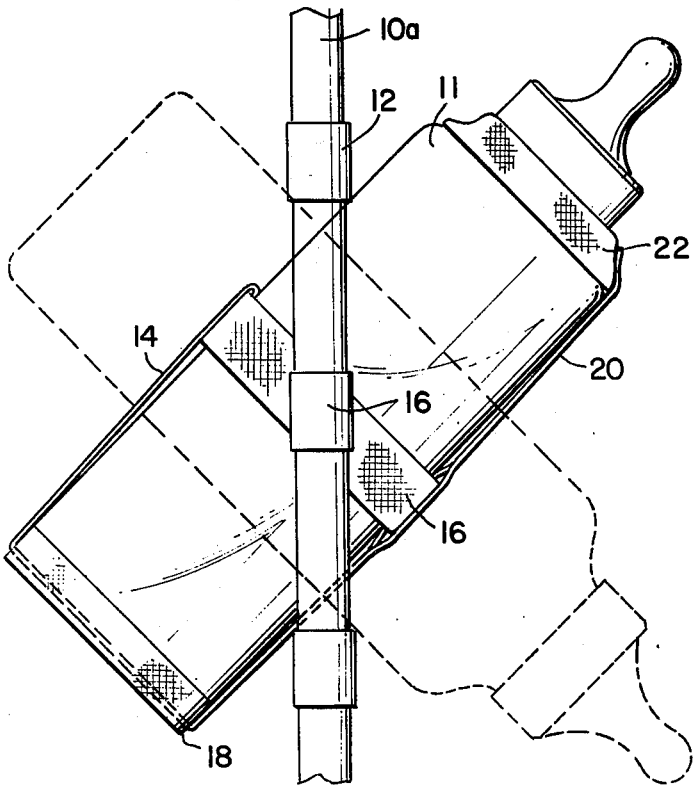

NURSING BOTTLE HOLDER

BACKGROUND OF THE INVENTION

This invention relates to nursing bottle holders; more particularly, to a holder that is adapted to provide for hanging the bottle from the crib bars such that the same is suspended above the infant's head and readily available for nursing.

The prior art teaches a variety of nursing holders, for example, as disclosed in U.S. Pat. Nos. 1,136,529; 1,375,917; 1,559,740; 1,630,167; 2,060,194; 2,199,869; 2,490,207; 2,991,032; 3,425,653; and others.

SUMMARY OF THE INVENTION

It is accordingly an object of the instant invention to provide for an improved nursing bottle holder.

It is another object to provide for a holder that is adapted to engage the baby's crib and provide for suspension of the nurser.

It is a further object to provide for the same at relatively little cost thereby making the same generally available.

These and other objects and advantages of the invention will become apparent from the following detailed disclosure and claims and by reference to the accompanying drawings, in which:

FIGS. 1 and 3 are perspective views;

FIG. 2 is a rear elevational view; and

Broadly speaking, the instant invention includes the provision of a holder for use in connection with a nursing bottle having a nipple and the parallel slats of a crib, comprising a first strap engaging the parallel slats and disposed transverse thereto, a second strap engaging the bottle and the slats and being transverse the slats, a third strap communicating with a disc for receiving and retaining the base of the bottle, the third strap communicating between the second strap and the disc, a portion of the third strap being looped and engaging the bottle adjacent the nipple whereby movement of the bottle is restrained.

DETAILED DISCLOSURE

Referring more particularly to the drawings, there is shown a pair of parallel crib bars at slats 10, 10*a* as is found on any conventional crib. The instant holder includes a first horizontal strap 12 that is transverse the slats 10, 10*a* and communicates with the two slats 10, 10*a* such as by being looped therearound. The bottle 11 is engaged by a second horizontal strap 16 which is disposed attached to first strap 12 in such a way as by being slipped between the two opposing members that form the second horizontal strap 16. A third strap 14 fitted with a circular recessed disc 18, i.e., a base 20 having an annular flange 22 therearound at one distal end and forming a looped portion or collar 18 at the opposite end for engaging the bottle 11 beneath the nipple cap traverses the length of the bottle 11. The third strap 14 thereby provides for restricted movement of the bottle 11 within the total sling device.

Strap 12 causes a bottle 11 to reside in a quasi-upright position, such that the nipple end of the bottle is located within the crib, caused by the urging of the resilient material of strap 16 so as to cause a point of bottle 11 to engage strap 12. A moderate force, applied by the infant's mouth or hand or both, causes the longitudinal axis of bottle 11 to be disposed towards the horizontal and indeed past it when the infant is feeding.

Since it is obvious that numerous changes and modifications can be made in the above-described details without departing from the spirit and nature of the invention, it is to be understood that all such changes and modifications are included within the scope of the invention.

I claim:

1. A holder for use in connection with a nursing bottle having a nipple and the parallel slats of a crib, comprising a first strap engaging said parallel slats and disposed transverse thereto, a second strap engaging said bottle and said slats and being transverse said slats, a third strap communicating with a disc for receiving and retaining the base of said bottle, said third strap communicating between said second strap and said disc, a portion of said third strap being looped and engaging said bottle adjacent said nipple whereby movement of said bottle between the looped portion of said third strap and said disc is restrained, wherein said second strap urges an outermost surface of said bottle to engage a portion of said first strap into touching engagement therewith, another portion of said third strap fastened to said second strap.

2. The holder as defined in claim 1, wherein said first, second and third straps are elastic.

3. The holder as defined in claim 1, wherein said disc includes a base and an annular collar therearound.

4. The holder as defined in claim 1, wherein said looped portion is at the distal end of said third strap.

5. The holder as defined in claim 1, wherein said second and third straps form a harness.

6. The holder as defined in Claim 1 wherein said second and third straps are unitary.

* * * * *